US008810615B2

(12) United States Patent
Takahashi et al.

(10) Patent No.: US 8,810,615 B2
(45) Date of Patent: Aug. 19, 2014

(54) DISPLAY DEVICE, DRIVE METHOD THEREOF, AND ELECTRONIC DEVICE

(75) Inventors: Kohzoh Takahashi, Osaka (JP); Kohji Saitoh, Osaka (JP); Asahi Yamato, Osaka (JP); Taketoshi Nakano, Osaka (JP); Toshihiro Yanagi, Osaka (JP); Akizumi Fujioka, Osaka (JP); Jun Nakata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/000,655

(22) PCT Filed: Apr. 3, 2012

(86) PCT No.: PCT/JP2012/059118

§ 371 (c)(1),
(2), (4) Date: Aug. 21, 2013

(87) PCT Pub. No.: WO2012/137791

PCT Pub. Date: Oct. 11, 2012

(65) Prior Publication Data

US 2014/0015870 A1 Jan. 16, 2014

(30) Foreign Application Priority Data

Apr. 7, 2011 (JP) ..... 2011-085813
Aug. 12, 2011 (JP) ..... 2011-177221
Dec. 21, 2011 (JP) ..... 2011-280500

(51) Int. Cl.
*G09G 5/10* (2006.01)

(52) U.S. Cl.
USPC ..... 345/691

(58) Field of Classification Search
CPC ..... G09G 2320/064; G09G 2360/14
See application file for complete search history.

(56) References Cited

U.S. PATENT DOCUMENTS 5,712,652 A 1/1998 Sato et al.
2002/0180673 A1 12/2002 Tsuda et al.
2004/0169632 A1 9/2004 Hosaka et al.
2004/0207756 A1 10/2004 Fujii et al.
2004/0212609 A1 10/2004 Igarashi (Continued)

FOREIGN PATENT DOCUMENTS

CN 1520681 A 8/2004
CN 1540395 A 10/2004

(Continued)

OTHER PUBLICATIONS

Official Communication issued in International Patent Application No. PCT/JP2012/059118, mailed on Jul. 10, 2012.

(Continued)

*Primary Examiner* — William Boddie
*Assistant Examiner* — Carolyn R Edwards
(74) *Attorney, Agent, or Firm* — Keating & Bennett, LLP

(57) ABSTRACT

A display device includes: a timing controller (10) for driving a scanning line driving circuit (4) and a signal line driving circuit (6) by providing a scanning period (T1) and a pause period (T2) which follows the scanning period (T1); a data analyzing section (101) for obtaining detection data on an external light intensity; and a BL luminance setting section (104) for outputting, at least during the pause period (T2), a BL control signal for adjusting, in accordance with the detection data obtained by the data analyzing section (101), a luminance of light to be emitted to a screen.

11 Claims, 10 Drawing Sheets

(56) References Cited

U.S. PATENT DOCUMENTS

| | | | | |
|---|---|---|---|---|
| 2004/0233135 | A1 | 11/2004 | Kim et al. | |
| 2007/0126697 | A1 | 6/2007 | Sato et al. | |
| 2008/0291326 | A1 | 11/2008 | Shishido et al. | |
| 2008/0297500 | A1 | 12/2008 | Kato | |
| 2009/0141332 | A1* | 6/2009 | Futatsuya et al. | 359/276 |
| 2010/0033456 | A1* | 2/2010 | Yoshida et al. | 345/207 |
| 2011/0001747 | A1 | 1/2011 | Shimizu et al. | |
| 2011/0128303 | A1 | 6/2011 | Yonemaru et al. | |
| 2011/0134154 | A1* | 6/2011 | Miyachi et al. | 345/690 |

FOREIGN PATENT DOCUMENTS

| | | | |
|---|---|---|---|
| CN | 1306322 | C | 3/2007 |
| CN | 100446063 | C | 12/2008 |
| JP | 05-61440 | A | 3/1993 |
| JP | 08-286170 | A | 11/1996 |
| JP | 2000-347762 | A | 12/2000 |
| JP | 2001-312253 | A | 11/2001 |
| JP | 2002-229524 | A | 8/2002 |
| JP | 2004-151222 | A | 5/2004 |
| JP | 2007-72243 | A | 3/2007 |
| JP | 2007-179000 | A | 7/2007 |
| JP | 2008-233925 | A | 10/2008 |
| JP | 2008-298997 | A | 12/2008 |
| JP | 2009-3420 | A | 1/2009 |
| JP | 2009-42664 | A | 2/2009 |
| JP | 2009-134211 | A | 6/2009 |
| JP | 2011-009701 | A | 1/2011 |

OTHER PUBLICATIONS

Takahashi et al., "Display Device," U.S. Appl. No. 14/237,970, filed Feb. 10, 2014.

* cited by examiner

FIG. 9

(a)

SOURCE INVERSION

| FREQUENCY (Hz) | 60 | 30 | 20 | 1 |
|---|---|---|---|---|
| ELECTRIC CURRENT VALUE (mA) | 126.6 | 93.9 | 81.9 | 59.3 |
| ELECTRIC POWER VALUE (mW) | 417.78 | 309.87 | 270.27 | 195.69 |

(b)

2H DOT INVERSION

| FREQUENCY (Hz) | 60 | 30 | 20 | 1 |
|---|---|---|---|---|
| ELECTRIC CURRENT VALUE (mA) | 191.7 | 126.3 | 103.9 | 60.3 |
| ELECTRIC POWER VALUE (mW) | 632.61 | 416.79 | 342.87 | 198.99 |

DISPLAY DEVICE, DRIVE METHOD THEREOF, AND ELECTRONIC DEVICE

TECHNICAL FIELD

The present invention relates to (i) a display device for displaying an image, a moving image, or the like, (ii) a method for driving the display device, and (iii) an electronic device which includes the display device.

BACKGROUND ART

In recent years, display devices have been extensively used which are thin, light, and low in electric power consumption, and are typified by liquid crystal display devices. Such display devices have been popularly provided in, for example, mobile phones, smart phones, and laptop personal computers. In addition, development and widespread use of electric paper which is a thinner display device are expected to be accelerated in the future. Under such circumstances, reducing electric power consumption in various kinds of display devices is a common object at present.

A method in which peripheral circuits such as a control circuit and a driving circuit of a display device are stopped (intermittently driven) is known as a first method for reducing electric power consumption.

For example, Patent Literature 1 discloses a method for driving a display device which achieves lower electric power consumption by providing a pause period that is longer than a scanning period in which a screen is scanned one time.

Furthermore, a method for controlling a luminance of a backlight (hereinafter abbreviated to "BL") in accordance with a result of detection of an external light intensity (hereinafter abbreviated to "BL control") is known as a second method for reducing electric power consumption.

Moreover, a method for achieving low electric power consumption while causing only a specific peripheral circuit to continue operating in a low electric power consumption mode is known as a third method for reducing electric power consumption.

For example, according to Patent Literature 2, a sleep clock whose frequency is lower than that of a normal operation clock and does not cause a flicker in a display is supplied to a driving circuit of a liquid crystal display device while operation of a CPU (central process unit) is stopped, so that the flicker in the display is prevented while lower electric power consumption is achieved.

CITATION LIST

Patent Literature 1

Japanese Patent Application Publication Tokukai, No. 2001-312253 A (Publication Date: Nov. 9, 2001)

Patent Literature 2

Japanese Patent Application Publication Tokukai, No. 2000-347762 A (Publication Date: Dec. 15, 2000)

SUMMARY OF INVENTION

Technical Problem

However, techniques described in Patent Literatures 1 and 2 have the following problems.

First, neither of Patent Literatures 1 and 2 describes the BL control, which is the second method.

Meanwhile, a simple combination of the technique described in Patent Literature 1 and the BL control may cause a deterioration in display quality during the pause period.

For example, according to the technique described in Patent Literature 1, peripheral circuits such as a control circuit and a driving circuit are stopped driving during the pause period. Accordingly, as a matter of course, it is considered that supply of a signal for the BL control is also stopped. Then, the BL control is not carried out at all during the pause period. This may cause a further deterioration in display quality during the pause period than during the scanning period. Furthermore, in the worst case, a BL may be completely turned off in the pause period.

The present invention has been made in view of the conventional problems, and an object of the present invention is to provide a display device and the like capable of preventing a deterioration in display quality during a pause period while reducing electric power consumption.

In order to attain the object, a display device of the present invention includes: a scanning line driving circuit for sequentially selecting a plurality of scanning signal lines included in a screen which is made up of a plurality of pixels arranged in a matrix pattern; a signal line driving circuit for sequentially supplying data signals via data signal lines to pixels connected to a selected one of the plurality of scanning signal lines, the data signal lines corresponding to the respective pixels; a driving control section for driving the scanning line driving circuit and the signal line driving circuit by providing (i) a scanning period during which one (1) screen is scanned and (ii) a pause period which follows the scanning period and during which all the plurality of scanning signal lines are in a non-scanning state; a detection data obtaining section for obtaining detection data on an external light intensity; and a luminance control signal outputting section for outputting, at least during the pause period, a luminance control signal for adjusting, in accordance with the detection data obtained by the detection data obtaining section, a luminance of light to be emitted to the screen.

In order to attain the object, a method for driving a display device of the present invention, the display device includes: a scanning line driving circuit for sequentially selecting a plurality of scanning signal lines included in a screen which is made up of a plurality of pixels arranged in a matrix pattern; and a signal line driving circuit for sequentially supplying data signals via data signal lines to pixels connected to a selected one of the plurality of scanning signal lines, the data signal lines corresponding to the respective pixels, the method includes the steps of: (a) driving the scanning line driving circuit and the signal line driving circuit by providing (i) a scanning period during which one (1) screen is scanned and (ii) a pause period which follows the scanning period and during which all the plurality of scanning signal lines are in a non-scanning state; (b) obtaining detection data on an external light intensity; and (c) outputting, at least during the pause period, a luminance control signal for adjusting, in accordance with the detection data obtained in the step (b), a luminance of light to be emitted to the screen.

According to the configuration or the method, the scanning line driving circuit and the signal line driving circuit are driven by the driving control section or in the step (a) by providing (i) a scanning period during which one (1) screen is scanned and (ii) a pause period which follows the scanning period and during which all the plurality of scanning signal lines are in a non-scanning state.

According to this, electric power consumption of the data signal line driving circuit, the electric power consumption increasing in proportion to a frequency at which the data signal is supplied, can be easily reduced by providing the pause period following the scanning period during which one (1) screen is rewritten.

Further, detection data on an external light intensity is obtained by the detection data obtaining section or in the step (b), and a luminance control signal for adjusting, in accordance with the detection data obtained in the step (b), a luminance of light to be emitted to the screen is outputted at least during the pause period by the luminance control signal outputting section or in the step (c). In other words, according to the display device of the present invention or the method for driving the display device, it is possible to adjust, at least during the pause period, a luminance of light to be emitted to the screen (hereinafter such an adjustment is referred to as "luminance value control").

Meanwhile, in a case where supply of a signal for the luminance value control is stopped during the pause period as in the case of a simple combination of the technique described in Patent Literature 1 and the luminance value control (e.g., BL control), the luminance value control is not carried out effectively, so that a trouble such as a flicker in a display is highly likely to occur.

However, according to the configuration or the method of the present invention, unlike the case of the simple combination of the technique described in Patent Literature 1 and the luminance value control, the luminance value control is not stopped at least during the pause period. Therefore, it is possible to prevent a trouble such as a flicker in a display which trouble occurs because the luminance value control is not carried out during the pause period.

As described earlier, it is possible to prevent a deterioration in display quality during the pause period while reducing electric power consumption.

In order to attain the object, an electronic device of the present invention includes: a display device includes: a scanning line driving circuit for sequentially selecting a plurality of scanning signal lines included in a screen which is made up of a plurality of pixels arranged in a matrix pattern; a signal line driving circuit for sequentially supplying data signals via data signal lines to pixels connected to a selected one of the plurality of scanning signal lines, the data signal lines corresponding to the respective pixels; a driving control section for driving the scanning line driving circuit and the signal line driving circuit by providing (i) a scanning period during which one (1) screen is scanned and (ii) a pause period which follows the scanning period and during which all the plurality of scanning signal lines are in a non-scanning state; a detection data obtaining section for obtaining detection data on an external light intensity; and a luminance control signal outputting section for outputting, at least during the pause period, a luminance control signal for adjusting, in accordance with the detection data obtained by the detection data obtaining section, a luminance of light to be emitted to the screen; a light detection section for outputting the detection data on the external light intensity; and a light emitting section for obtaining the luminance control signal outputted by the luminance control signal outputting section of the display device, and adjusting, in accordance with the obtained luminance control signal, the luminance of the light to be emitted to the screen.

According to the configuration, the light detecting section outputs the detection data on the external light intensity. Further, the light emitting section obtains the luminance control signal outputted by the luminance control signal outputting section of the display device, and adjusts, in accordance with the obtained luminance control signal, the luminance of the light to be emitted to the screen.

Therefore, it is possible to provide an electronic device which is capable of preventing a deterioration in display quality during the pause period while reducing electric power consumption.

Advantageous Effects of Invention

As described above, a display device of the present invention includes: a scanning line driving circuit for sequentially selecting a plurality of scanning signal lines included in a screen which is made up of a plurality of pixels arranged in a matrix pattern; a signal line driving circuit for sequentially supplying data signals via data signal lines to pixels connected to a selected one of the plurality of scanning signal lines, the data signal lines corresponding to the respective pixels; a driving control section for driving the scanning line driving circuit and the signal line driving circuit by providing (i) a scanning period during which one (1) screen is scanned and (ii) a pause period which follows the scanning period and during which all the plurality of scanning signal lines are in a non-scanning state; a detection data obtaining section for obtaining detection data on an external light intensity; and a luminance control signal outputting section for outputting, at least during the pause period, a luminance control signal for adjusting, in accordance with the detection data obtained by the detection data obtaining section, a luminance of light to be emitted to the screen.

As described above, a method for driving a display device of the present invention includes the steps of: (a) driving the scanning line driving circuit and the signal line driving circuit by providing (i) a scanning period during which one (1) screen is scanned and (ii) a pause period which follows the scanning period and during which all the plurality of scanning signal lines are in a non-scanning state; (b) obtaining detection data on an external light intensity; and (c) outputting, at least during the pause period, a luminance control signal for adjusting, in accordance with the detection data obtained in the step (b), a luminance of light to be emitted to the screen.

As described above, an electronic device of the present invention includes: the display device; a light detection section for outputting the detection data on the external light intensity; and a light emitting section for obtaining the luminance control signal outputted by the luminance control signal outputting section of the display device, and adjusting, in accordance with the obtained luminance control signal, the luminance of the light to be emitted to the screen.

Therefore, it is possible to prevent a deterioration in display quality during the pause period while reducing electric power consumption.

Additional objects, features and strengths of the present invention will be made clear by the description below. Further, the advantages of the present invention will be evident from the following explanation in reference to the drawings.

Figure 5:
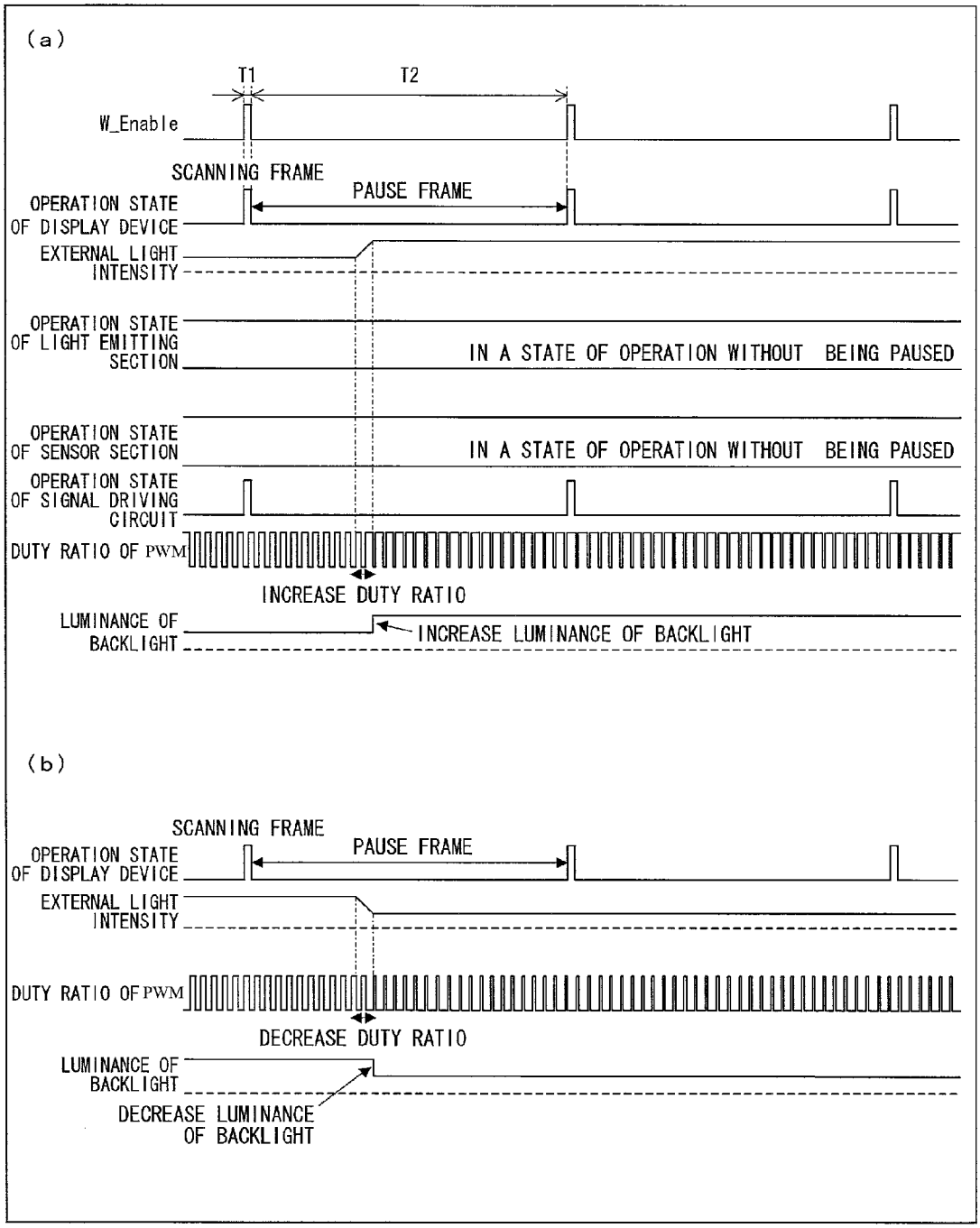

(a) and (b) of FIG. 5 are timing charts for the display system each showing states of a W_Enable signal, operations of members of a display device, an external light intensity which enters a screen (display panel), a duty ratio of a PWM signal, and a luminance of a backlight. (a) of FIG. 5 shows a state in which the external light intensity increases, and (b) of FIG. 5 shows a state in which the external light intensity decreases.

Figure 6:
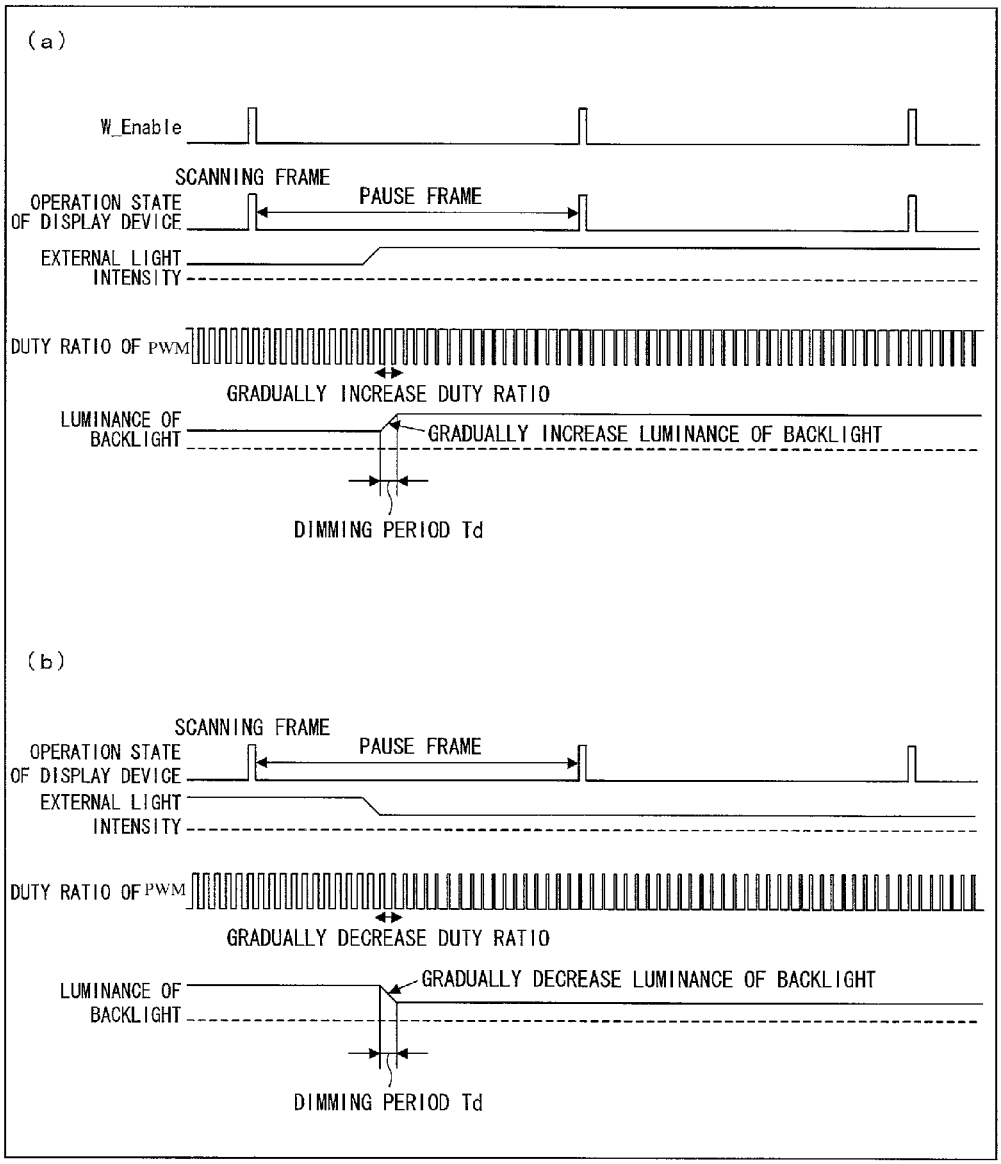

(a) and (b) of FIG. 6 are timing charts for the display system each showing states of a W_Enable signal, an operation of a display device, an external light intensity which enters a screen, a duty ratio of a PWM signal, and a luminance of a backlight. (a) of FIG. 6 shows a state in which the external light intensity gradually increases, and (b) of FIG. 6 shows a state in which the external light intensity gradually decreases.

Figure 7:
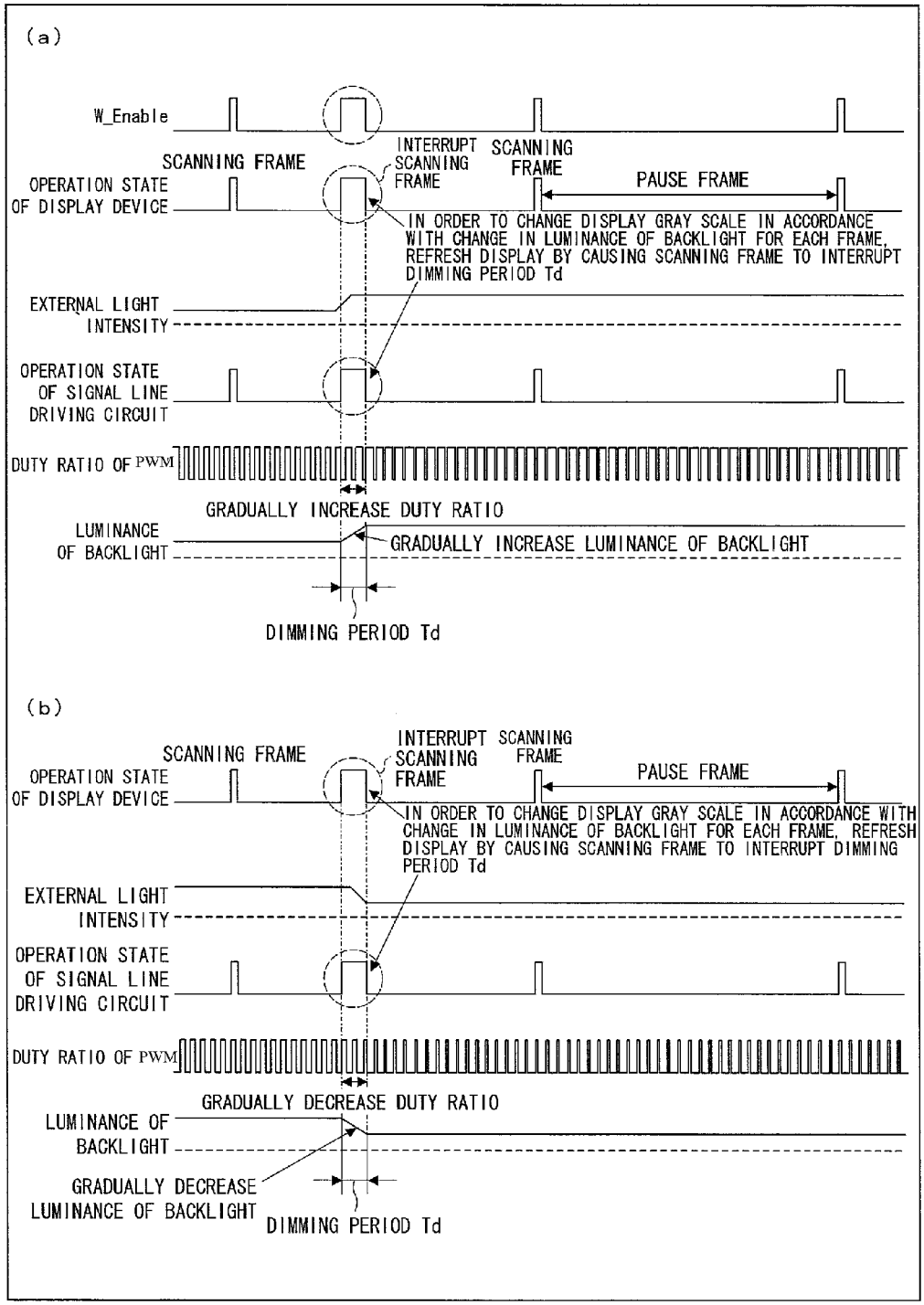

(a) and (b) of FIG. 7 are timing charts for the display system each showing states of a W_Enable signal, operations of members of a display device, an external light intensity which enters a screen, a duty ratio of a PWM signal, and a luminance of a backlight. (a) of FIG. 7 shows a state in which a new scanning period interrupts a dimming period during which the duty ratio of the PWM signal is gradually increased and (b) of FIG. 7 shows a state in which a new scanning period interrupts a dimming period during which the duty ratio of the PWM signal is gradually decreased.

Figure 8:
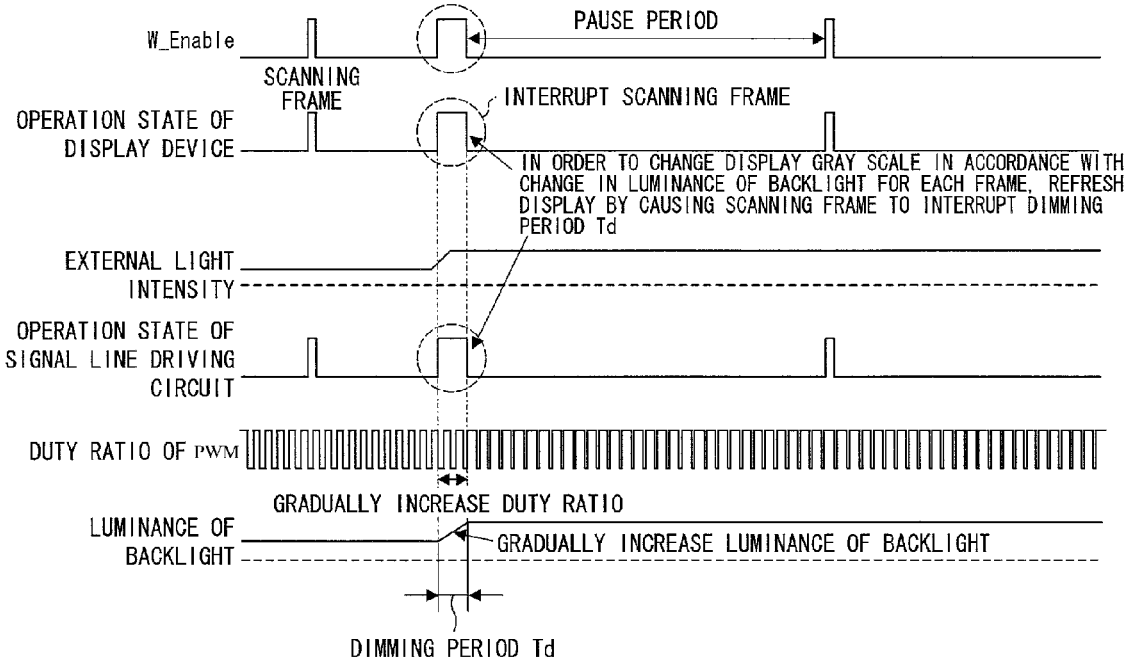

FIG. 8 is a timing chart for the display system, the timing chart showing states of a W_Enable signal, operations of members of a display device, an external light intensity which enters a screen, a duty ratio of a PWM signal, and a luminance of a backlight in a case where a new scanning period interrupts a dimming period during which the duty ratio of the PWM signal is gradually increased.

FIG. 9 shows an electric power consumption characteristic of a display device.

Figure 10:
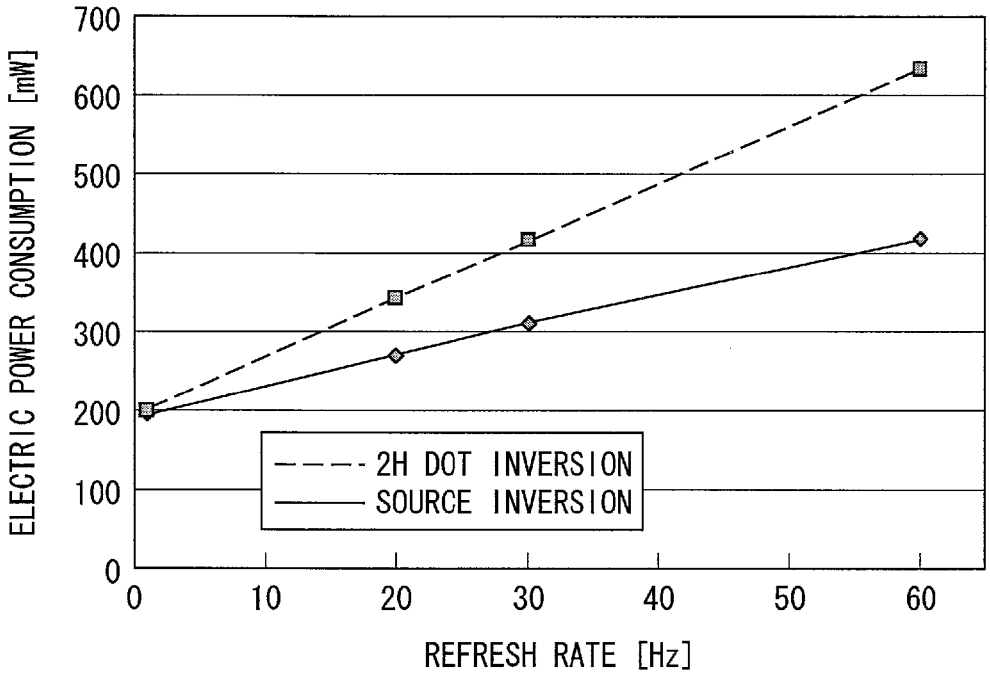

FIG. 10 is a graph showing the electric power consumption characteristic shown in FIG. 9.

DESCRIPTION OF EMBODIMENTS

The following discusses an embodiment of the present invention with reference to FIGS. 1 to 10. Note that a description of a configuration other than that described in a specific section below may be omitted according to need. However, in a case where the configuration whose description is omitted is described in another section, the configuration is identical to that described in the another section. Note also that, for convenience of description, members that have functions identical to those of the respective members described in the sections are given respective identical reference numerals, and a description thereof is omitted as appropriate.

[1. Configuration of Display System 100]

Figure 1:
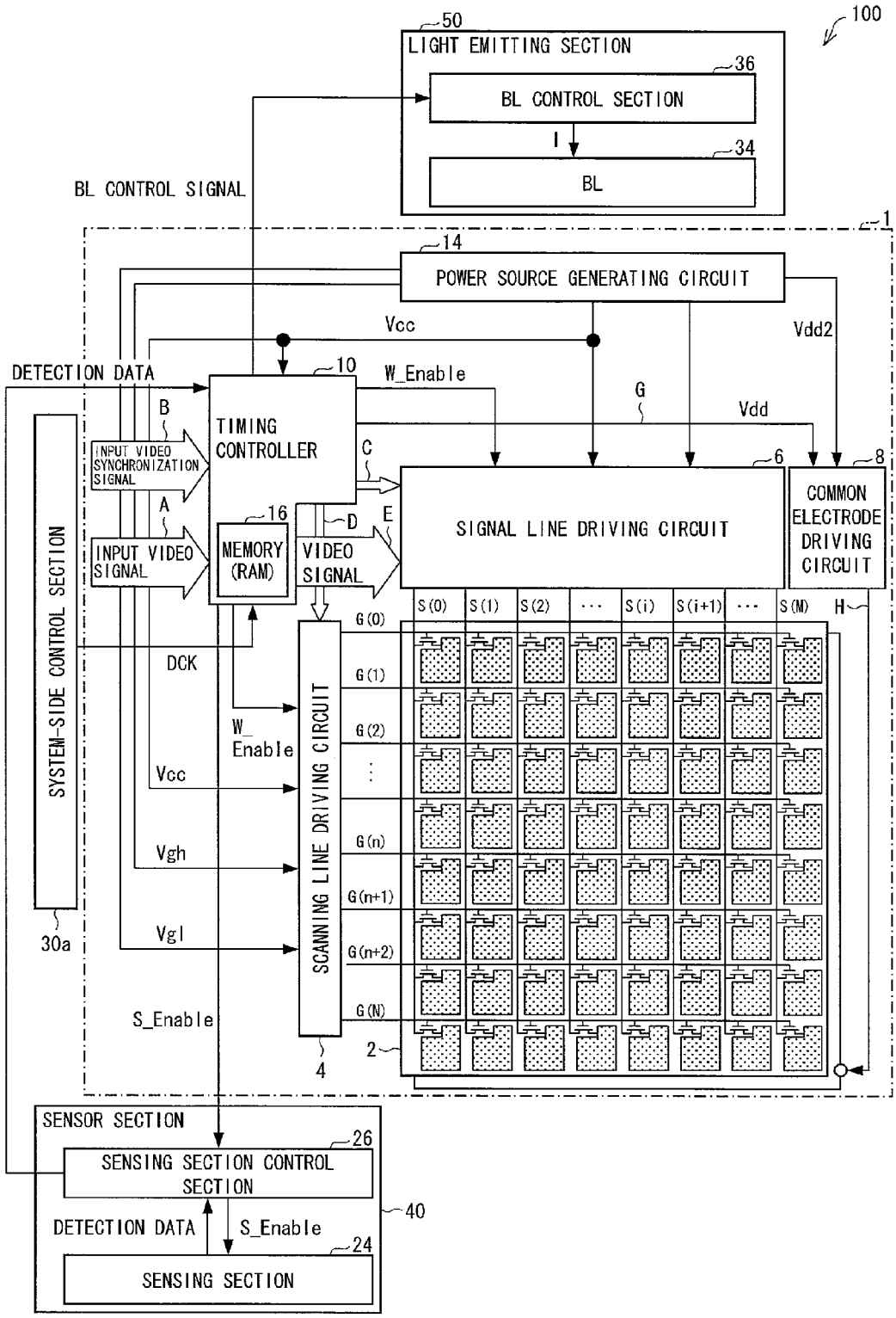
FIG. 1 is a block diagram illustrating an overall configuration of a display system of an embodiment of the present invention.
Figure 2:
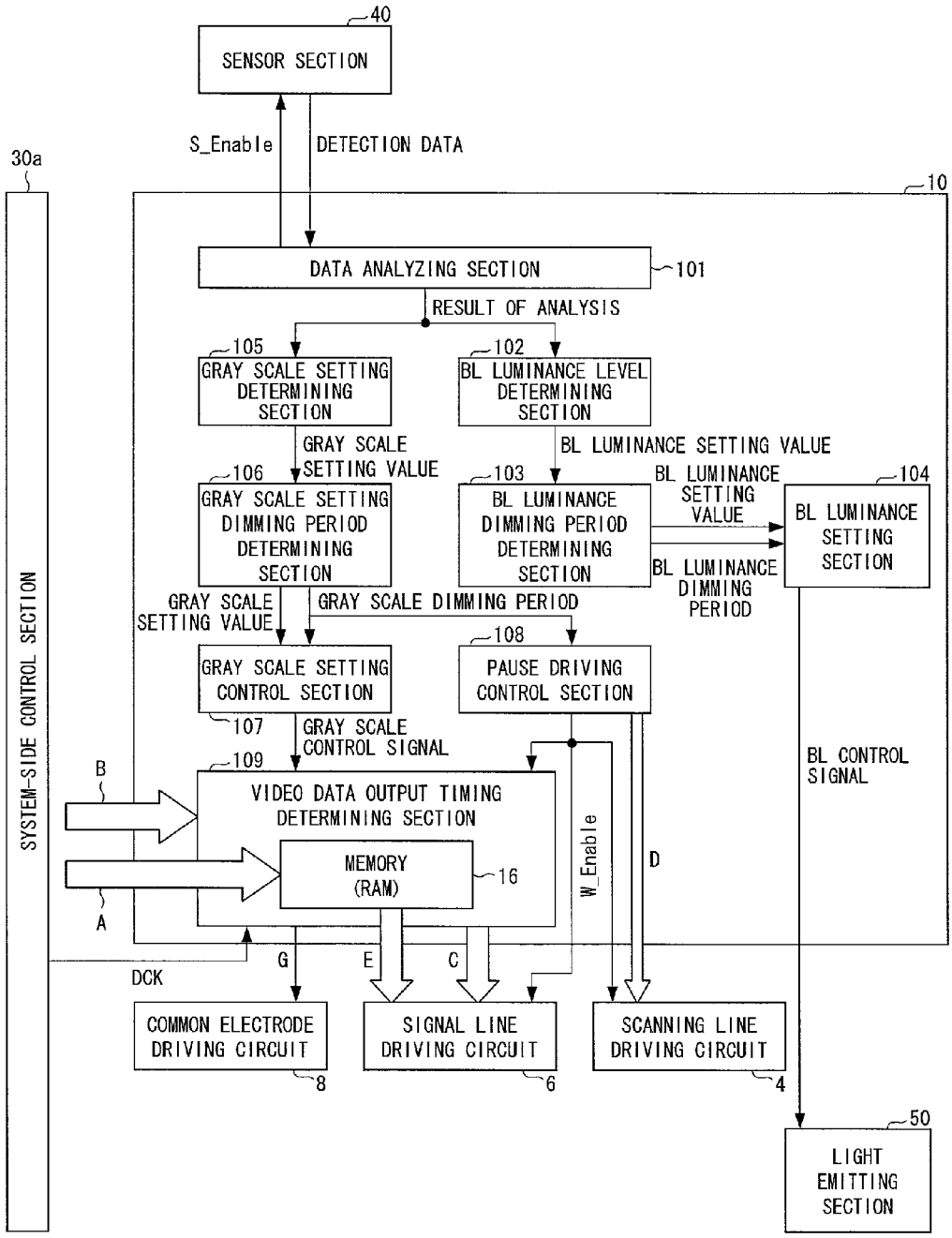
FIG. 2 is a block diagram illustrating a configuration of a relevant part of the display system.

The following discusses, with reference to FIGS. 1 and 2, a configuration of a display system (display device) 100 which is an embodiment of the present invention. FIG. 1 is a block diagram illustrating an overall configuration of the display system 100. The display system 100 includes a display device 1, a system-side control section 30*a*, a sensor section (light detection section) 40, and a light emitting section 50 (see FIG. 1).

<System-Side Control Section 30*a*>

The system-side control section 30*a* supplies, to a timing controller 10, (i) an input video signal (indicated by an arrow A) and (ii) a horizontal synchronization signal (Hsync signal), a vertical synchronization signal (Vsync signal indicated by an arrow B) as input video synchronization signals, and (iii) an input clock signal (dot clock signal DCK).

<Display Device 1>

The following discusses the present embodiment by taking an active matrix liquid crystal display device as an example of the display device 1. However, the present invention, which is not limited to this, is applicable to, for example, an EL (electroluminescence) display device which is addressed with use of a TFT element. The display device 1 can be provided in, for example, a portable phone, a portable game player, a PDA (personal digital assistants), a portable TV, a remote controller, a laptop personal computer, or another portable terminal. Such a portable device is generally battery-driven by a battery. In a case where the portable device is provided with the display device 1 which is capable of preventing a deterioration in display quality while reducing electric power consumption, the portable device can be easily driven for a long time.

The display device 1 includes a display panel (screen) 2, a scanning line driving circuit 4, a signal line driving circuit 6, a common electrode driving circuit 8, the timing controller (driving control section) 10, and a power source generating circuit 14.

(Display Panel 2)

The display panel 2 includes N scanning signal lines G(n) (gate lines, n is an integer which satisfies $0 \leq n \leq N$ where N is a natural number) for scanning a screen by line-sequentially selecting the screen, which is made up of a plurality of pixels arranged in a matrix pattern. The display panel 2 further includes M data signal lines S(i) (source lines, i is an integer which satisfies $0 \leq i \leq M$ where M is a natural number) for supplying data signals to pixels belonging to (connected to) a selected gate line. The scanning signal lines G(n) and the data signal lines S(i) intersect with each other.

In FIG. 1, G(n) represents an n-th scanning signal line. For example, G(1), G(2), and G(3) represent a first scanning signal line, a second scanning signal line, and a third scanning signal line, respectively. Meanwhile, S(i) represents an i-th data signal line. For example, S(1), S(2), and S(3) represent a first data signal line, a second data signal line, and a third data signal line, respectively.

Note that, for convenience of description, the present embodiment takes, as an example, driving of an equivalent circuit. The pixels of the display panel 2 include respective TFTs, each of which has a drain electrode that is connected to a pixel electrode.

(Scanning Line Driving Circuit 4)

The scanning line driving circuit 4 line-sequentially scans the scanning signal lines G(n) from top to bottom of the screen. During the scanning, the scanning line driving circuit 4 supplies a rectangular wave (scanning signal) to each of the scanning signal lines G(n) so as to turn on a switching element (TFT) which is included in a pixel and connected to a pixel electrode. This causes the pixels belonging to one (1) line in the screen to be in a selected state.

(Signal Line Driving Circuit 6)

The signal line driving circuit 6 receives a video signal (indicated by an arrow E) supplied from the memory 16. In response to the video signal, the signal line driving circuit 6 calculates a value of a voltage to be supplied to each of the pixels belonging to a selected line, and then supplies, to each of the data signal lines S(i), the voltage having the value thus calculated. As a result, image data (a data signal) is supplied to each of the pixels belonging to a selected one of the scanning signal lines G(n).

(Common Electrode Driving Circuit 8)

The display device 1 further includes a common electrode (not shown) which is provided for each of the pixels of the screen. The common electrode driving circuit 8 drives the common electrode by supplying a predetermined common voltage to the common electrode in response to a polarity inversion signal (indicated by an arrow G) supplied from the timing controller 10.

(Timing Controller 10)

The timing controller 10 includes the memory 16 (see FIG. 1). The memory 16 has a function to record the input video signal (indicated by the arrow A) supplied from the system-side control section 30*a*. Note that the following description of the present embodiment assumes that the display device 1 includes the memory 16. However, the display device 1 does not necessarily include the memory 16.

Note also that the following description of the present embodiment assumes that the memory 16 is included in the timing controller 10. However, the memory 16 and the timing controller 10 can be separately provided.

The timing controller 10 receives the horizontal synchronization signal (Hsync signal) and the vertical synchronization signal (Vsync signal) as input video synchronization signals, and the dot clock signal DCK (indicated by the arrow B). The timing controller 10 generates, in accordance with these input video synchronization signals and the dot clock signal DCK, a horizontal synchronization system control signal (such as a gate clock signal GCK) and a vertical synchronization system control signal (such as a gate start pulse signal GSP) as video synchronization signals which serve as a criterion by which the circuits are synchronized to operate. Then, the timing controller 10 supplies the signals thus generated to each of the scanning line driving circuit 4 and the signal line driving circuit 6 (indicated by an arrow C and an arrow D, respectively). In accordance with the video synchronization signals and the dot clock signal DCK each of which has been received by the timing controller 10, the memory 16 supplies, to the signal line driving circuit 6, the video signal (indicated by the arrow E) based on the recorded input video signal.

More specifically, the timing controller 10 (i) delivers, to the scanning line driving circuit 4, the gate start pulse signal GSP, the gate clock signal GCK, and the gate output enable signal GOE, and (ii) delivers, to the signal line driving circuit 6, RGB gray scale data, a source start pulse signal SSP, a source latch strobe signal SLS, and a source clock signal SCK.

The video signal stored in the memory 16 is data from which a data signal is generated.

The scanning line driving circuit 4, which serves as a scanning signal line driver, supplies, to each of the scanning signal lines of the display panel 2, a voltage corresponding to each of a selected period and a non-selected period. Specifically, the scanning line driving circuit 4 starts scanning the display panel 2 in response to the gate start pulse signal GSP received from the timing controller 10 and then sequentially applies, in accordance with the gate clock signal GCK, selected voltages to the respective scanning signal lines.

The signal line driving circuit 6, which serves as a data signal line driver, supplies a data signal to each of the data signal lines of the display panel 2 and then supplies image data to each of the pixels belonging to a selected one of the scanning signal lines. Specifically, in response to the source start pulse signal SSP received from the timing controller 10, the signal line driving circuit 6 stores, in a register (not shown) in accordance with the source clock signal SCK, gray scale data on each of the pixels, the gray scale data having been transmitted from the timing controller 10. Then, the signal line driving circuit 6 writes the gray scale data to each of the data signal lines of the display panel 2 in accordance with a subsequent source latch strobe signal SLS.

The timing controller 10 further includes a pause driving control section 108 which generates a pause driving control signal (hereinafter referred to as a W_Enable signal) by adjusting the vertical synchronization system control signal (such as a pulse interval between gate start pulse signals GSP) and the horizontal synchronization system control signal (such as a frequency of a gate clock signal GCK) (see FIG. 2).

The pause driving control section 108 drives the scanning line driving circuit 4 and the signal line driving circuit 6 by providing (i) a scanning period T1 during which one (1) screen is scanned and (ii) a pause period T2 which follows the scanning period and during which all the scanning signal lines are in a non-scanning state. Note that the pause period T2 can be shorter in length than the scanning period T1. However, from the viewpoint of achievement of lower electric power consumption, it is preferable that the pause period T2 be longer in length than the scanning period T1.

Note here that the pulse interval between the gate start pulse signals GSP is approximately 16.7 msec in a case where a display is carried out at a normal frequency of 60 Hz. For example, the pause driving control section 108 increases the pulse interval between the gate start pulse signals GSP to 167 msec. In a case where a length of the scanning period T1 during which one (1) screen is scanned remains to be normal, approximately nine-tenths of the pulse interval is a period during which all the scanning signal lines are in the non-scanning state. As such, the non-scanning period (a period during which all the scanning signal lines are in an unselected state) from a point in time at which the scanning period T1 is ended to a point in time at which the gate start pulse signal GSP is supplied to the scanning line driving circuit 4 again may be set by the pause driving control section 108 so that the non-scanning period is longer than the scanning period T1.

In the case where the pause driving control section 108 sets the pause period T2 as the non-scanning period, one (1) display cycle (period) is a sum of the scanning period T1 and the pause period T2. For example, in a case where the scanning period T1 is set to a period equivalent to a normal frequency of 60 Hz, a vertical frequency is lower than 30 Hz due to presence of the pause period T2 which is longer than the scanning period T1. The scanning period T1 and the non-scanning period can be appropriately set in accordance with a degree of motion in an image such as a still image or a moving image which is desired to be displayed. According to the pause driving control section 108, it is possible to set a plurality of non-scanning periods in accordance with contents of the image.

As described earlier, in a case where the pause period T2 is provided, it is possible to reduce the number of times the screen is rewritten, i.e., a frequency at which a data signal from the signal line driving circuit 6 is supplied. This allows a reduction in electric power for use in charging a pixel. Therefore, in a case where the display device 1 is an active matrix liquid crystal display device which is capable of securing basic display qualities such as a brightness, a contrast, a response speed, and a gray scale level, and the pause period T2 is set as the non-scanning period, it is possible to easily and sufficiently reduce, without sacrificing the display qualities, electric power consumption of the signal line driving circuit 6, the electric power consumption increasing in proportion to the frequency at which the data signal is supplied.

In view of the above, for a display of an image with no motion such as a still image or a moving image with less motion, the non-scanning period may be set to a long pause period T2. Meanwhile, for a display of a moving image with much motion, the non-scanning period may be set to a short pause period T2. For example, in a case where the non-scanning period is set to a non-scanning period which is sufficiently short with respect to a scanning period of 16.7 msec, a driving frequency during the non-scanning period is equivalent to a normal frequency of 60 Hz. This makes it possible to display a moving image at a sufficiently high speed. In contrast, in a case where the non-scanning period is set to a long pause period T2 of 3333 msec, electric power consumed by rewriting a screen can be reduced while a basic display quality of a still image or a moving image with less motion is maintained. Namely, it is possible to use the display panel 2 by switching between a moving image display and a display with lower electric power consumption. Since periods in which a screen is rewritten can thus be changed in accordance with types of display images such as a still image and a moving image, it is possible to achieve lower electric power consumption that is optimum for each of the types of display images.

Note that, unless otherwise noted, "one vertical period" herein refers to a period specified in accordance with the Vsync signal and "one horizontal period" herein refers to a period specified in accordance with the Hsync signal. However, in a case where the display device 1 includes the memory 16 as in the case of the present embodiment, and the display device 1 is capable of, for example, a double-speed display, it is also possible to assume a case where a clock generation circuit is separately included in the display device 1. In such a case, regardless of one signal vertical period and one horizontal period which are specified by the Vsync signal and the Hsync signal, respectively, each being supplied from the system-side control section 30*a* side, one vertical period and one horizontal period may be specified with use of a time interval between clocks included in the display device 1.

Note that a unit length of each of a scanning frame, a pause frame, and an interrupt scanning frame (which are described later) is one vertical period, and each vertical period is counted as one frame. For example, in a case where a pause frame has a length equivalent to nine vertical periods, this means that the pause frame has a length of nine frames.

In response to the horizontal synchronization system control signal, the vertical synchronization system control signal, and the W_Enable signal which have been received from the timing controller 10, the scanning line driving circuit 4 starts scanning of the display panel 2, and sequentially selects the scanning signal lines G(n), so as to supply the scanning signals to the scanning signal lines G(n) thus selected.

In response to the horizontal synchronization system control signal and the W_Enable signal which have been received from the timing controller 10, the signal line driving circuit 6 sequentially writes, to the data signal line S(i) of the display panel 2, image data (data signals) in accordance with the video signal received from the memory 16.

Next, the following specifically discusses, with reference to FIG. 2, members of the timing controller 10. FIG. 2 is a block diagram illustrating a configuration of a relevant part of the display system 100. The timing controller 10 includes a data analyzing section (detection data obtaining section) 101, a BL luminance level determining section 102, a BL luminance dimming period determining section 103, a BL luminance setting section (luminance control signal outputting section) 104, a gray scale setting determining section 105, a gray scale setting dimming period determining section 106, a gray scale setting control section (gray scale control signal outputting section) 107, the pause driving control section 108, and a video data output timing determining section 109 (see FIG. 2).

The data analyzing section 101 transmits a sensing instruction signal (hereinafter referred to as an S_Enable signal) to a sensor section 40 at a predetermined timing.

A sensing section control section 26 of the sensor section 40 receives the S_Enable signal so as to operate a sensing section 24 and then receives detection data (analog) detected by the sensing section 24. The sensing section control section 26 carries out the following calculation processes (1) to (4) with respect to the detection data (analog) received from the sensing section 24, and then returns a result of the calculation processes to the data analyzing section 101.

(1) A/D (analog/digital) conversion is carried out with respect to the detection data (analog data) so as to output detection data (digital data).

(2) A noise in the detection data (digital data) is removed with use of a 50/60 Hz flicker removing filter.

(3) The detection data (digital data) is multiplied by a predetermined correction coefficient.

(4) The detection data (digital data) is filtered with use of a median filter.

Note that the median filter arranges results of the calculation (3) (corresponding to voltage values detected from respective PDs (photo diodes) arranged in a matrix pattern (described later)) in an ascending order so as to extract a median of the results of the calculation (3).

The data analyzing section 101 receives the result of the calculation processes from the sensing section control section 26 (a detection data obtaining step), determines to which of a predetermined plurality of stages of luminous intensity level categories (output criteria, e.g., 16 stages of categories provided on each of an upper side and a lower side with respect to a reference luminous intensity level) a value of the result of the calculation processes belongs. Then, the data analyzing section 101 notifies the BL luminance level determining section 102 of a luminance intensity level category obtained by the determination.

The BL luminance level determining section 102 determines a BL luminance setting value (luminance setting value) in accordance with the luminance intensity level category notified by the data analyzing section 101. Then, the BL luminance level determining section 102 passes the BL luminance setting value thus determined to the BL luminance dimming period determining section 103.

As described earlier, the external light intensity (detection data) and the BL luminance setting value are associated in advance so as to have a correspondence relationship. The BL luminance level determining section 102 determines the BL luminance setting value in accordance with the correspondence relationship. Note that the plurality of stages of luminous intensity level categories is associated so that the luminance intensity level increases (decreases) as the external light intensity increases (decreases). According to this, even in a case where the external light intensity changes in the pause period T2, it is possible to determine whether to make a luminance of backlight (light) higher or lower, so that BL control (luminance value control) can be suitably carried out during the pause period. This makes it possible to prevent a deterioration in display quality.

The BL luminance dimming period determining section 103 determines a length (the number of frames) of a dimming period Td during which the BL control is carried out. Note that according to the present embodiment, the dimming period Td can be set to a period of one (I) frame up to 256 frames (256 stages). Note, however, that the dimming period Td is not limited to the 256 stages but can be set to more than 256 stages (256 frames).

Next, the determined dimming period Td is passed to the BL luminance setting section 104. Note that the BL luminance setting section 104 may determine, during the dimming period Td including at least one (1) frame, the BL luminance setting value for each vertical synchronization period (each frame) included in the dimming period Td (an output criterion).

This makes it possible to dynamically carry out the BL control in accordance with a change in external light intensity as more frames are included in the dimming period Td. Therefore, the luminance of the backlight can be adjusted with hardly any flicker occurring in a display.

The BL luminance setting section 104 generates, as a BL control signal, a pulse width modulation signal (PWM signal) in accordance with the BL luminance setting value and the dimming period Td which have been received from the BL luminance dimming period determining section 103, and then passes the pulse width modulation signal thus generated to the light emitting section 50 (BL control section 36) (a luminance control signal outputting step). Note that a duty ratio of the PWM signal changes in accordance with the BL luminance setting value. Namely, the duty ratio of the PWM signal is high when the BL luminance setting value is great, whereas the duty ratio of the PWM signal is low when the BL luminance setting value is small.

Note that the present embodiment discusses a case where a higher duty ratio of the PWM signal causes a backlight to be brighter. However, the present invention is not limited to such a case. For example, in contrast, in case of a circuit in which a lower duty ratio of the PWM signal causes a backlight to be brighter, the duty ratio of the PWM signal is low when the BL luminance setting value is great, whereas the duty ratio of the PWM signal is high when the BL luminance setting value is small.

As described earlier, in a case where the PWM signal is used as the BL control signal (luminance control signal) to be transmitted from the BL luminance setting section 104 to the BL control section 36, it is possible to adjust a luminance of a backlight by supplying the PWM signal to the BL control section 36 with use of a single leading wire. This allows configurations of the display system 100 and a display system 200 to be simpler.

The data analyzing section 101 receives the result of the calculation processes from the sensing section control section 26, determines to which of a predetermined plurality of stages of gray scale value categories (output criteria, e.g., 16 stages of categories provided on each of an upper side and a lower side with respect to a reference gray scale level) a value of the received result of the calculation processes belongs. Then, the data analyzing section 101 notifies the gray scale setting determining section 105 of a gray scale value category obtained by the determination.

The gray scale setting determining section 105 determines a gray scale setting value in accordance with the gray scale value category notified by the data analyzing section 101. Then, the gray scale setting determining section 105 passes the gray scale setting value thus determined to the gray scale setting dimming period setting section 106.

As described earlier, the external light intensity (detection data) and the gray scale setting value are associated in advance so as to have a correspondence relationship. The gray scale setting determining section 105 determines the gray scale setting value in accordance with the correspondence relationship. Note that the plurality of stages of gray scale value categories is associated so that the gray scale value increases (decreases) as the external light intensity increases (decreases). According to this, even in a case where the external light intensity changes in the pause period T2, it is possible to determine whether to make the gray scale value of each of the pixels of the display panel 2 higher or lower, so that image processing (hereinafter referred to as "gray scale value control") can be suitably carried out in accordance with the external light intensity during the pause period. This makes it possible to prevent a deterioration in display quality.

The gray scale setting dimming period determining section 106 determines a length (the number of frames) of a dimming period Td during which the gray scale value control is carried out. Note that the dimming period during which the BL control is carried out and the dimming period during which the gray scale value control is carried out may be separately provided. However, the present embodiment provides a shared dimming period, and refers to the shared period as the dimming period Td.

The determined dimming period Td is passed to each of the gray scale setting control section 107 and the pause driving control section 108.

The gray scale setting control section 107 generates a gray scale control signal (e.g., gray scale data) in accordance with the gray scale setting value and the dimming period Td which have been received from the gray scale setting dimming period determining section 106, and then passes the gray scale control signal to the video data output timing determining section 109. Note that the video data output timing determining section 109 may allow the memory 16 to temporarily store the gray scale setting value and the dimming period Td which have been received.

The pause driving control section 108 generates a W_Enable signal which causes an interrupt scanning frame to interrupt the dimming period Td.

Note that the gray scale setting determining section 105 may set, during the dimming period Td including at least one (1) vertical synchronization period, the gray scale control signal for each vertical synchronization period (each frame) (an output criterion).

This makes it possible to dynamically carry out the gray scale value control in accordance with a change in external light intensity as more frames are included in the dimming period Td. Therefore, the gray scale value of each of the pixels of the display panel 2 can be adjusted with hardly any flicker occurring in a display.

Note here that a BL luminance dimming period and a gray scale value dimming period may be identical or different in period.

(Power Source Generation Circuit 14)

The power source generation circuit 14 generates Vdd, Vdd2, Vcc, Vgh, and Vgl, which are voltages required to cause respective circuits of the display device 1 to operate. The power source generation circuit 14 supplies Vcc, Vgh, and Vgl to the scanning line driving circuit 4, Vdd and Vcc to the signal line driving circuit 6, Vcc to the timing controller 10, and Vdd2 to the common electrode driving circuit 8.

<Sensor Section 40>

The sensor section 40 includes the sensing section 24 and the sensing section control section 26.

(Sensing Section Control Section 26)

The sensing section control section 26 receives a detection instruction signal from the timing controller 10, generates a sensing section driving signal, and then supplies the sensing section driving signal to the sensing section 24. Note that the present embodiment refers to both the detection instruction signal and the sensing section driving signal as "S_Enable signals". Furthermore, the sensing section control section 26 carries out the calculation processes with respect to the detection data (analog) received from the sensing section 24, and then supplies a result of the calculation processes to the timing controller 10.

(Sensing Section 24)

The sensing section 24 includes one or more optical sensors (not shown). The sensing section 24 carries out a detection operation in response to the S_Enable signal received from the sensing section control section 26 and then returns, to the sensing section control section 26, detection data (analog) obtained by the detection operation.

Note that the description of the present embodiment assumes that the sensing section 24 includes a so-called touch sensor which is obtained by providing each of the pixels with an optical sensor. Namely, the display panel 2 of the display device 1 includes, for example, a photo diode (PD) provided in each of the pixels as an optical sensor. The PD is connected to a capacitor, and an electric charge amount of the capacitor is changed in accordance with a change in amount of light which enters the PD and is received by the PD. An intensity of the light which enters the PD can be detected by detecting voltages at both ends of the capacitor. Note that, since the light which enters the PD contains a component of external light which enters the display panel 2, an intensity of the external light which enters the display panel 2 can be detected by analyzing the detection data.

<Light Emitting Section 50>

The light emitting section 50 includes a BL (backlight) 34 and the BL (backlight) control section 36.

(BL 34)

The BL 34 includes a plurality of LEDs (light emitting diodes). Each of the LEDs emits light by an electric current I supplied from the BL control section 36 (i.e., backlight is emitted from the BL 34). The backlight emitted from the BL 34 is directed to the display panel 2.

Note that the description of the present embodiment assumes that the BL (backlight) 34 is provided as an example of a light source (light emitting section) which emits light to the display panel 2. However, the light source which emits light to the display panel 2 is not limited to a backlight, but may be, for example, a front light.

(BL Control Section 36)

The BL control section 36 changes, in accordance with the duty ratio of the pulse width modulation signal (PWM signal) received from the BL luminance setting section 104, an effective value of the electric current I to be supplied to each of the plurality of LEDs which constitute the BL 34, and then supplies, to the BL 34, the electric current I whose effective value has been changed.

[2. Configuration of Display System 200]

Figure 3:
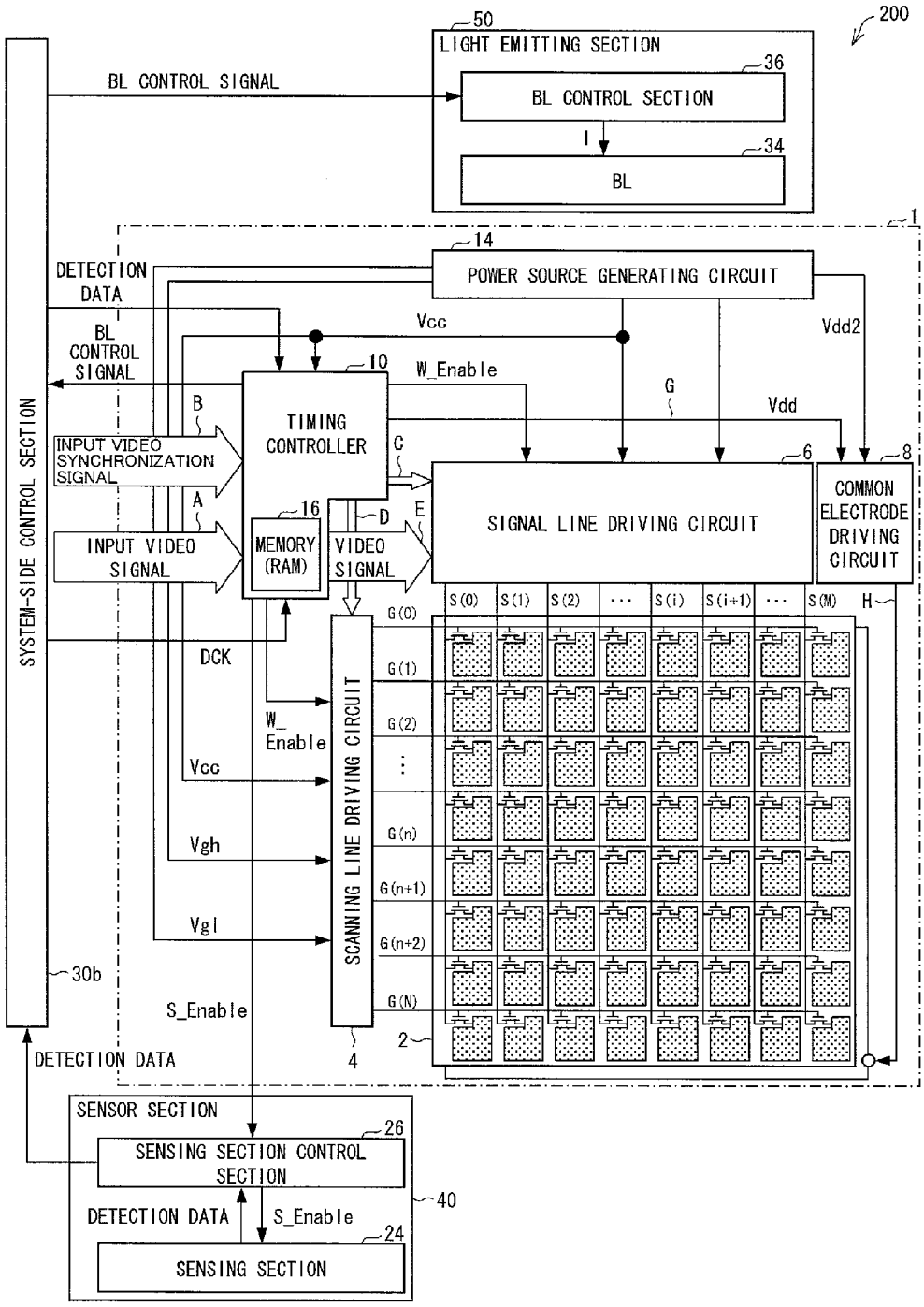
FIG. 3 is a block diagram illustrating an overall configuration of a display system of another embodiment of the present invention.
Figure 4:
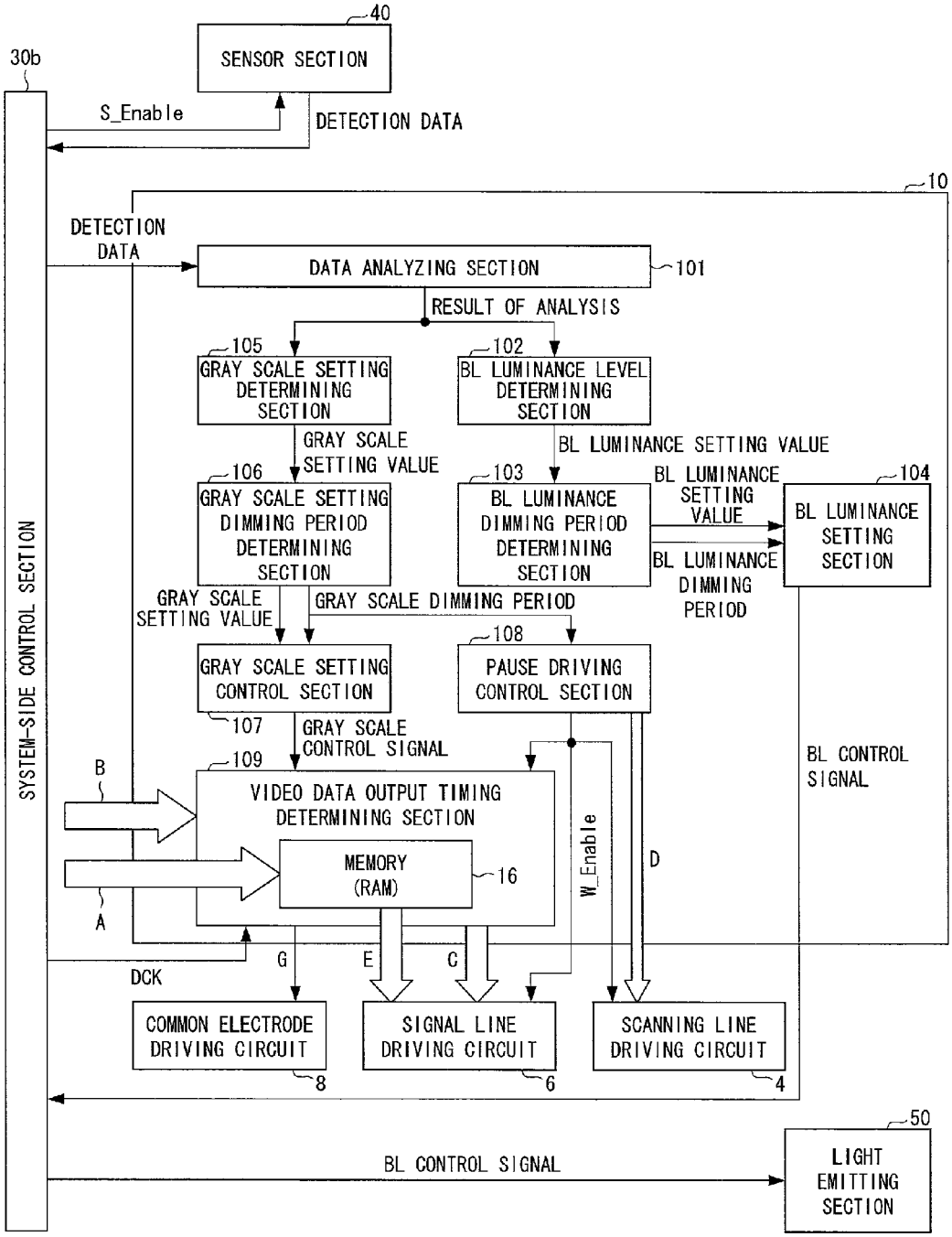
FIG. 4 is a block diagram illustrating a configuration of a relevant part of the display system.

Next, the following discusses, with reference to FIGS. 3 and 4, a configuration of the display system (display device) 200 which is another embodiment of the present invention. FIG. 3 is a block diagram illustrating an overall configuration of the display system 200, and FIG. 4 illustrates a configuration of a relevant part of the display system 200.

The display system 200 of the present embodiment is different from the display system 100 in the following points:

(1) A system-side control section (driving control section) 30*b* transmits the S_Enable signal to the sensor section 40 and then receives detection data (calculation result) from the sensor section 40. Note that the system-side control section 30*b* passes the received detection data to the timing controller 10. Note also that the display system 200 may be configured such that the sensing section control section 26 passes, directly to the system-side control section 30*b*, the detection data (analog) received from the sensing section 24, and the system-side control section 30*b* carries out the calculation processes.

(2) The system-side control section 30*b* receives the BL control signal from the BL luminance setting section 104 and then passes the received BL control signal to the light emitting section 50. Note that the display system 200 may be configured such that the BL luminance setting section 104 passes, directly to the system-side control section 30*b*, the BL luminance setting value and the dimming period Td which have been received from the BL luminance dimming period determining section 103, and the system-side control section 30*b* generates the PWM signal and then transmits the PWM signal to the light emitting section 50.

Note that, since the other configurations of the display system 200 are identical to those of the display system 100, a description thereof is omitted here.

[Main Operations of the Display Systems 100 and 200]

The following discusses, with reference to FIGS. 5 to 8, main operations of the display systems 100 and 200.

Example 1

First, the following discusses, with reference to (a) and (b) of FIG. 5, an example (Example 1) of the main operations of the display systems 100 and 200.

As described earlier, the timing controller 10 drives the scanning line driving circuit 4 and the signal line driving circuit 6 by providing (i) the scanning period T1 (scanning frame) during which one (1) screen is scanned and (ii) the pause period T2 (pause frame) which follows the scanning period T1 and during which all the scanning signal lines are in a non-scanning state (a driving control step).

According to this, electric power consumption of the signal line driving circuit 6, the electric power consumption increasing in proportion to a frequency at which the data signal is supplied, can be easily reduced by providing the pause period T2 following the scanning period T1 during which one (1) screen is rewritten.

The sensor section 40 detects the external light intensity (light detection step). Note that (a) of FIG. 5 illustrates a state in which the external light intensity increases as time passes from a given point in the pause period T2. Meanwhile, (b) of FIG. 5 illustrates a state in which the external light intensity decreases as time passes from a given point in the pause period T2.

According to the display devices 100 and 200, the sensor section 40 and the light emitting section are in a state of operation (operating) without being paused at least during the pause period T2 (see (a) of FIG. 5).

More specifically, as the sensor 40 detects a higher external light intensity, the BL control section 36 increases a luminance of the backlight to be emitted from the BL 34 to the display panel 2 ((a) of FIG. 5). Meanwhile, as the sensor 40 detects a lower external light intensity, the BL control section 36 decreases a luminance of the backlight to be emitted from the BL 34 to the display panel 2. Note that according to the present example, a duty ratio of a pulse width modulation signal PWM increases (or decreases) for each frame (an output criterion). Therefore, unlike a gradual change in external light intensity, the luminance of the BL 34 changes steeply (see FIG. 5).

In other words, each of the display systems 100 and 200 carries out the BL control (and/or gray scale value control) at least during the pause period T2. Note here that it is preferable to set the pause period T2 to be comparatively longer than the scanning period T1 since a longer pause period T2 yields a greater effect of achieving lower electric power consumption (described earlier). In this case, a change in external light intensity is more likely to be captured in the pause period T2 than in the pause period T2. Meanwhile, when the BL control (and/or the gray scale value control) are/is stopped during the pause period T2 as in the case of a simple combination of the technique described in Patent Literature 1 and the BL control (and/or the gray scale value control), the BL control (and/or the gray scale value control) are/is not carried out effectively, so that a trouble such as a flicker in a display is highly likely to occur.

However, according to the display systems 100 and 200, unlike the case of the simple combination of the technique described in Patent Literature 1 and the BL control (and/or the gray scale value control), the BL control (and/or the gray scale value control) are/is not stopped at least during the pause period T2. Therefore, it is possible to prevent a trouble such as a flicker in a display which trouble occurs because the BL control (and/or gray scale value control) is/are not carried out during the pause period T2.

As described earlier, it is possible to prevent a deterioration in display quality during the pause period while reducing electric power consumption.

Meanwhile, the case of a simple combination of the technique described in Patent Literature 2 and the BL control (and/or the gray scale value control) causes a side problem such that a display quality may deteriorate in a low electric power consumption mode (or in the pause period).

For example, according to the technique described in Patent Literature 2, a sleep clock whose frequency is lower than that of a normal operation clock is supplied to a driving circuit of a liquid crystal display device in the low electric power consumption mode, so that a clock frequency which serves as a criterion for the BL control (and/or the gray scale value control) is naturally decreased.

Therefore, operation of the BL control (and/or the gray scale value control) is also carried out at a low speed in the low electric power consumption mode. Thus, in a case where dynamic active BL control (and/or dynamic gray scale value control) are/is carried out, a function of the dynamic active BL control (and/or the dynamic gray scale value control) cannot be sufficiently carried out. This may cause a trouble such as a flicker in a display.

In order to solve such a side problem, according to the display systems 100 and 200, the BL luminance setting section 104 and/or the gray scale setting control section 107 output(s) the luminance control signal and/or the gray scale control signal during the pause period T2 by an output criterion identical to an output criterion by which the BL luminance setting section 104 and/or the gray scale setting control section 107 output(s) the luminance control signal and/or the gray scale control signal during the scanning period T1.

Note that examples of a case where "output criteria are identical" include (i) a case where a time interval at which luminance value control is carried out during the pause period T2 is identical to a time interval at which the luminance value control is carried out during the scanning period T1 and (ii) a case where a criterion for determining the BL luminance setting value and/or the gray scale setting value with respect to the external light intensity during the pause period T2 is identical to a criterion for determining the luminance setting value with respect to the external light intensity during the scanning period T1.

This causes the luminance value control (and/or the gray scale value control) to be carried out during the pause period in accordance with the output criterion identical to the output criterion by which the luminance value control (and/or the gray scale value control) are/is carried out during the scanning period. Accordingly, unlike the technique described in, for example, Patent Literature 2, operation of the luminance value control (and/or the gray scale value control) is not carried out at a lower speed during the pause period. Namely, since the luminance value control (and/or the gray scale value control) are/is carried out similarly during the scanning period and the pause period, a function(s) of dynamic luminance value control (and/or dynamic gray scale value control) can be fully carried out during both the scanning period and the pause period. This makes it possible to prevent a deterioration in display quality.

Example 2

Next, the following discusses, with reference to (a) and (b) of FIG. 6, another example (Example 2) of the main operations of the display systems 100 and 200.

(a) and (b) of FIG. 6 each illustrate a case where the dimming period Td during which the BL control is carried out includes a plurality of frames.

According to the present example, during the dimming period Td including the plurality of frames, the BL control section 36 gradually adjusts a luminance of backlight for each of the plurality of frames included in the dimming period Td.

Note that according to the examples of (a) and (b) of FIG. 6, an external light intensity gradually increases (or gradually decreases) and thus the luminance of the backlight is also increased (or gradually decreased).

Meanwhile, for example, in a case where during the dimming period Td, the external light intensity gradually increases (or gradually decreases) and then gradually decreases (or gradually increases), the luminance of the backlight is also gradually increased and then gradually decreased (or is gradually decreased and then gradually increased).

In other words, according to the display systems 100 and 200, it is possible to carry out the BL control dynamically in accordance with a change in external light intensity as more frames are included in the dimming period Td. Therefore, the luminance of the backlight can be adjusted with hardly any flicker occurring in a display.

Example 3

Next, the following discusses, with reference to (a) and (b) of FIG. 7, and FIG. 8, a further example (Example 3) of the main operations of the display systems 100 and 200.

(a) and (b) of FIG. 7, and FIG. 8 each illustrate a case where the dimming period Td during which the BL control is carried out includes a plurality of frames.

According to the present example, in order that the gray scale value control is carried out together with the BL control during the dimming period Td during which the BL control is carried out, the dimming period Td is interrupted by a new scanning period (an interrupt scanning period or an interrupt scanning frame).

According to the configuration, it is possible to rewrite (refresh) a display in the interrupt scanning frame. Thus, the configuration makes it possible to set a higher refresh rate than a case where no interrupt scanning frame is provided. Therefore, it is possible to prevent a flicker which easily occurs when the refresh rate decreases due to a characteristic of the display panel 2.

Note that the interrupt scanning period may be returned to the pause period by ending the interrupt scanning period at a timing at which the dimming period Td is ended (a timing at which the output of the BL control signal is stopped) (see (a) and (b) of FIG. 7, and FIG. 8).

Note that the interrupt scanning period may be returned to the pause period by the following methods (1) and (2).

(1) The method in which the pause period in which the interrupt scanning frame is present is not reset (see (a) of FIG. 7 (or (b) of FIG. 7)).

(2) The method in which the pause period in which the interrupt scanning frame is present is reset (see FIG. 8).

In the case of (1), the pause period in which the interrupt scanning frame is present is not reset. Therefore, regardless of presence or absence of the interrupt scanning frame, the scanning frame except the interrupt scanning frame has a constant length of T1, and the pause period has a constant length of T2.

Meanwhile, in the case of (2), the pause period in which the interrupt scanning frame is present is reset. Therefore, a subsequent scanning frame is provided after the pause period T2 has passed from a point at which the interrupt scanning frame was ended.

(Effect of Reducing Electric Power Consumption)

FIG. 9 is a table showing an electric power consumption characteristic of a display device. FIG. 10 is a graph showing the electric power consumption characteristic shown in FIG. 9.

The electric power consumption characteristic is possessed by a 10.8-inch liquid crystal display device which uses an oxide semiconductor as a TFT of each pixel.

The electric power consumption characteristic shows that it is possible to reduce electric power consumption as a refresh rate of a display panel is decreased.

Furthermore, the electric power consumption characteristic shows that regardless of the refresh rate, it is also possible to reduce electric power consumption by changing a polarity inversion mode from a "2H dot inversion" to a "source inversion".

Namely, the electric power consumption characteristic shows that it is possible to reduce electric power consumption not only by decreasing the refresh rate of the display panel but also by changing the polarity inversion mode.

Assume here that in the display device, the "source inversion" is set as the polarity inversion type and "60 Hz" is set as the refresh rate. In this case, electric power consumption of the display device is "417.78 mW".

Then, assume that the refresh rate is decreased to "30 Hz" in the display device. In this case, electric power consumption of the display device is "309.87 mW". This means that the electric power consumption is reduced by "107.91 mW".

Assume also that in the display device, the polarity inversion mode is changed from the "source inversion" to the "2H dot inversion" so as to prevent a deterioration in display image quality due to the change in refresh rate. In this case, the electric power consumption of the display device is "416.79 mW". This means that the electric power consumption is increased by "106.92 mW".

The amount of the increase in electric power consumption is smaller than that of the reduction in electric power consumption due to the change in refresh rate. This consequently means that the deterioration in display image quality is prevented while the electric power consumption is reduced.

This shows that, even though the electric power consumption is increased so as to prevent the deterioration in display image quality due to the decrease in refresh rate, it is possible to prevent the increase from exceeding the amount of reduction in electric power consumption due to the decrease in refresh rate.

[Another Description of the Present Invention]

The present invention may also be described as below.

First, the case of a simple combination of the technique described in Patent Literature 2 and the luminance value control causes a side problem such that a display quality may deteriorate in a low electric power consumption mode (or in the pause period).

For example, according to the technique described in Patent Literature 2, a sleep clock whose frequency is lower than that of a normal operation clock is supplied to a driving circuit of a liquid crystal display device in the low electric power consumption mode, so that a clock frequency which serves as a criterion for the luminance value control is naturally decreased.

Therefore, operation of the luminance value control is also carried out at a low speed in the low electric power consumption mode. Thus, in a case where dynamic luminance value control (for example, active BL control in which a luminance value of a backlight is adjusted in accordance with a result of detection of an external light intensity) is carried out, a function of the dynamic luminance value control cannot be sufficiently carried out. This may cause a trouble such as a flicker in a display.

In addition to the above configuration, the display device of the present invention may also have a configuration such that the luminance control signal outputting section outputs the luminance control signal during the pause period by an output criterion identical to an output criterion by which the luminance control signal outputting section outputs the luminance control signal during the scanning period.

The above configuration causes the luminance value control to be carried out during the pause period in accordance with the output criterion identical to the output criterion by which the luminance value control is carried out during the scanning period. Accordingly, unlike the technique described in, for example, Patent Literature 2, operation of the luminance value control is not carried out at a lower speed during the pause period. Namely, since the luminance value control is carried out similarly during the scanning period and the pause period, a function of dynamic luminance value control can be fully carried out during both the scanning period and the pause period. This makes it possible to prevent a deterioration in display quality.

Note that examples of a case where "output criteria are identical" include (i) a case where a time interval at which luminance value control is carried out during the pause period is identical to a time interval at which the luminance value control is carried out during the scanning period and (ii) a case where a criterion for determining a luminance of light with respect to the external light intensity during the pause period is identical to a criterion for determining the luminance of the light with respect to the external light intensity during the scanning period.

The display device of the present invention may be configured such that the luminance control signal outputting section generates the luminance control signal in accordance with a luminance setting value to be determined based on a correspondence relationship between a predetermined external light intensity and the luminance of the light to be emitted to the screen.

According to the above configuration, even in a case where the external light intensity changes in the pause period, it is possible to determine whether to make a luminance of light higher or lower, so that luminance value control can be suitably carried out during the pause period. This makes it possible to prevent a deterioration in display quality.

The display device of the present invention may be configured such that the luminance control signal outputting section outputs, during a dimming period during which the luminance of the light is adjusted and which includes at least one vertical synchronization period, the luminance control signal for each of the at least one vertical synchronization period included in the dimming period.

According to the above configuration, it is possible to carry out luminance value control dynamically in accordance with a change in external light intensity as more vertical synchronization periods are included in the dimming period. Therefore, the luminance of light can be adjusted with hardly any flicker occurring in a display.

In addition to the above configuration, the display device of the present invention may also have a configuration such that the driving control section provides a new scanning period in the dimming period.

According to the above configuration, it is possible to rewrite (refresh) a display in the new scanning period. Thus, the configuration makes it possible to set a higher refresh rate than a case where no new scanning period is provided. Therefore, it is possible to prevent a flicker which easily occurs when the refresh rate decreases due to a characteristic of the screen (display panel).

The display device of the present invention may be configured such that the driving control section returns the new scanning period to the pause period by ending the new scanning period at a timing at which the luminance control signal outputting section stops outputting the luminance control signal.

According to the above configuration, since it is possible to prevent the new scanning period from being unnecessarily long, electric power consumption can be saved accordingly.

The display device of the present invention may be configured such that the luminance control signal outputting section generates, as the luminance control signal, a pulse width modulation signal whose duty ratio is adjusted in accordance with the luminance setting value to be determined based on the correspondence relationship.

According to the above configuration, it is possible to adjust a luminance of light by supplying the pulse width modulation signal (PWM signal) to, for example, the light emitting section with use of a single leading wire. This allows a configuration of the display device to be simpler.

The display device of the present invention may be a liquid crystal display device.

According to the above configuration, it is possible to realize a liquid crystal display device which is capable of preventing a deterioration in display quality while reducing electric power consumption during the pause period.

Electric power consumption may be reduced by a method for reducing electric power consumption (hereinafter abbreviated to "gray scale value control") in which a gray scale value to be supplied to each of the plurality of pixels of the screen is controlled in accordance with a result of detection of an external light intensity.

However, in a case where supply of a signal for the gray scale value control is stopped during the pause period as in the case of a simple combination of the technique described in Patent Literature 1 and the gray scale value control, the gray scale value control is not carried out effectively. This causes a side problem such that a trouble such as a flicker in a display is highly likely to occur.

The display device of the present invention may further include a gray scale control signal outputting section for outputting, at least during the new scanning period, a gray scale control signal for adjusting a gray scale value to be supplied to each of the plurality of pixels of the screen in accordance with the detection data obtained by the detection data obtaining section.

According to the above configuration, the gray scale control signal outputting section outputs, at least during the new scanning period, a gray scale control signal for adjusting a gray scale value to be supplied to each of the plurality of pixels of the screen in accordance with the detection data obtained by the detection data obtaining section. In other words, according to the display device of the present invention, it is possible to carry out the gray scale value control at least during the new scanning period.

Therefore, it is possible to prevent a trouble such as a flicker in a display which trouble occurs because the gray scale value control is not carried out during the pause period.

The display device of the present invention may be configured such that the gray scale control signal outputting section generates the gray scale control signal in accordance with a gray scale setting value to be determined based on a correspondence relationship between the predetermined external light intensity and the gray scale value to be supplied to each of the plurality of pixels of the screen.

According to the above configuration, even in a case where the external light intensity changes in the pause period, it is possible to determine whether to make the gray scale value to be supplied to each of the plurality of pixels of the screen higher or lower, so that gray scale value control can be suitably carried out during the pause period. This makes it possible to prevent a deterioration in display quality.

The display device of present invention may be configured such that the gray scale control signal outputting section outputs the gray scale control signal for each of vertical synchronization periods included in the new scanning period.

According to the above configuration, it is possible to carry out gray scale value control dynamically in accordance with a change in external light intensity as more vertical synchronization periods are included in the new scanning period. Therefore, the gray scale value to be supplied to each of the plurality of pixels of the screen can be adjusted with hardly any flicker occurring in a display.

The display device of the present invention may be configured such that the output criterion includes a criterion for causing a time interval at which the luminance control signal outputting section carries out luminance value control during the pause period to be identical to a time interval at which the luminance control signal outputting section carries out the luminance value control during the scanning period. The display device of the present invention may also be configured such that the output criterion includes a criterion for causing a criterion for determining the luminance setting value with respect to the external light intensity during the pause period to be identical to a criterion for determining the luminance setting value with respect to the external light intensity during the scanning period.

This causes the luminance value control to be carried out during the pause period in accordance with the output criterion identical to the output criterion by which the luminance value control is carried out during the scanning period. Accordingly, unlike the technique described in, for example, Patent Literature 2, operation of the luminance value control is not carried out at a lower speed during the pause period. Namely, since the luminance value control is carried out similarly during the scanning period and the pause period, a function of dynamic luminance value control can be fully carried out during both the scanning period and the pause period. This makes it possible to prevent a deterioration in display quality.

[Additional Remarks]

Note that the present invention is not limited to the foregoing embodiments, but rather can be applied in many variations within the scope of the claims. That is, a new embodiment obtained from a proper combination of various embodiments with disclosed technical means is also included in technical scope of the present invention.

INDUSTRIAL APPLICABILITY

A display device of the present invention can be widely applied to various display devices such as a liquid crystal display device, an organic EL display device, and electric paper.

REFERENCE SIGNS LIST

1 Display device (liquid crystal display device)
2 Display panel (screen)
4 Scanning line driving circuit
6 Signal line driving circuit
10 Timing controller (driving control section)
30*b* System-side control section (driving control section)
40 Sensor section (light detection section)
50 Light emitting section
100, 200 Display system (display device)
101 Data analyzing section (detection data obtaining section)
104 BL luminance setting section (luminance control signal outputting section)
107 Gray scale setting control section (gray scale control signal outputting section)
T1 Scanning period
T2 Pause period
Td Dimming period

The invention claimed is:

1. A display device comprising:

a scanning line driving circuit configured to sequentially select a plurality of scanning signal lines included in a screen which is made up of a plurality of pixels arranged in a matrix pattern;

a signal line driving circuit configured to sequentially supply data signals via data signal lines to pixels connected to a selected one of the plurality of scanning signal lines, the data signal lines corresponding to the respective pixels;

a driving control section configured to drive the scanning line driving circuit and the signal line driving circuit by providing (i) a scanning period during which one (1) screen is scanned and (ii) a pause period which follows the scanning period and during which all the plurality of scanning signal lines are in a non-scanning state;

a detection data obtaining section configured to obtain detection data on an external light intensity; and a luminance control signal outputting section configured to output, at least during the pause period, a luminance control signal configured to adjust, in accordance with the detection data obtained by the detection data obtaining section, a luminance of light to be emitted to the screen, wherein the luminance control signal outputting section generating the luminance control signal in accordance with a luminance setting value to be determined based on a correspondence relationship between a predetermined external light intensity and the luminance of the light to be emitted to the screen, the luminance control signal outputting section outputting, during a dimming period during which the luminance of the light is adjusted and which includes at least one vertical synchronization period, the luminance control signal for each of the at least one vertical synchronization period included in the dimming period, the driving control section is configured to provide a new scanning period in the dimming period, and the driving control section is configured to return the new scanning period to the pause period by ending the new scanning period at a timing at which the luminance control signal outputting section stops outputting the luminance control signal.

2. The display device as set forth in claim 1, wherein the luminance control signal outputting section outputs the luminance control signal during the pause period by an output criterion identical to an output criterion by which the luminance control signal outputting section outputs the luminance control signal during the scanning period.

3. The display device as set forth in claim 2, wherein the output criterion includes a criterion which causes a time interval at which the luminance control signal outputting section carries out luminance value control during the pause period to be identical to a time interval at which the luminance control signal outputting section carries out the luminance value control during the scanning period.

4. The display device as set forth in claim 2, wherein:

the output criterion includes a criterion which causes a criterion used to determine the luminance setting value with respect to the external light intensity during the pause period to be identical to a criterion for determining the luminance setting value with respect to the external light intensity during the scanning period.

5. The display device as set forth in claim 1, wherein the luminance control signal outputting section generates, as the luminance control signal, a pulse width modulation signal whose duty ratio is adjusted in accordance with the luminance setting value to be determined based on the correspondence relationship.

6. The display device as set forth in claim 1, wherein the display device is a liquid crystal display device.

7. A display device as set forth in claim 1, further comprising a gray scale control signal outputting section configured to output, at least during the new scanning period, a gray scale control signal configured to adjust a gray scale value to be supplied to each of the plurality of pixels of the screen in accordance with the detection data obtained by the detection data obtaining section.

8. The display device as set forth in claim 7, wherein the gray scale control signal outputting section generates the gray scale control signal in accordance with a gray scale setting value to be determined based on a correspondence relationship between the predetermined external light intensity and the gray scale value to be supplied to each of the plurality of pixels of the screen.

9. The display device as set forth in claim 8, wherein the gray scale control signal outputting section outputs the gray scale control signal for each of vertical synchronization periods included in the new scanning period.

10. A method for driving a display device, the display device including:

a scanning line driving circuit configured to sequentially select a plurality of scanning signal lines included in a screen which is made up of a plurality of pixels arranged in a matrix pattern; and a signal line driving circuit configured to sequentially supply data signals via data signal lines to pixels connected to a selected one of the plurality of scanning signal lines, the data signal lines corresponding to the respective pixels, said method comprising the steps of:

(a) driving the scanning line driving circuit and the signal line driving circuit by providing (i) a scanning period during which one (1) screen is scanned and (ii) a pause period which follows the scanning period and during which all the plurality of scanning signal lines are in a non-scanning state;

(b) obtaining detection data on an external light intensity; and (c) outputting, at least during the pause period, a luminance control signal for adjusting, in accordance with the detection data obtained in the step (b), a luminance of light to be emitted to the screen, wherein in the step (c), the luminance control signal being generated in accordance with a luminance setting value to be determined based on a correspondence relationship between a predetermined external light intensity and the luminance of the light to be emitted to the screen, and during a dimming period during which the luminance of the light is adjusted and which includes at least one vertical synchronization period, the luminance control signal being outputted for each of the at least one vertical synchronization period included in the dimming period, in the step (a), and the new scanning period is provided in the dimming period, and the new scanning period is returned to the pause period by ending the new scanning period at a timing at which the luminance control signal is stopped from being outputted in the step (c).

11. An electronic device comprising:

a display device including:

a scanning line driving circuit configured to sequentially select a plurality of scanning signal lines included in a screen which is made up of a plurality of pixels arranged in a matrix pattern;

a signal line driving circuit configured to sequentially supply data signals via data signal lines to pixels connected to a selected one of the plurality of scanning signal lines, the data signal lines corresponding to the respective pixels;

a driving control section configured to drive the scanning line driving circuit and the signal line driving circuit by providing (i) a scanning period during which one (1) screen is scanned and (ii) a pause period which follows the scanning period and during which all the plurality of scanning signal lines are in a non-scanning state;

a detection data obtaining section configured to obtain detection data on an external light intensity; and a luminance control signal outputting section configured to output, at least during the pause period, a luminance control signal configured to adjust, in accordance with the detection data obtained by the detection data obtaining section, a luminance of light to be emitted to the screen;

a light detection section configured to output the detection data on the external light intensity; and a light emitting section configured to obtain the luminance control signal outputted by the luminance control signal outputting section of the display device, and to adjust, in accordance with the obtained luminance control signal, the luminance of the light to be emitted to the screen, wherein the luminance control signal outputting section generating the luminance control signal in accordance with a luminance setting value to be determined based on a correspondence relationship between a predetermined external light intensity and the luminance of the light to be emitted to the screen, the luminance control signal outputting section outputting, during a dimming period during which the luminance of the light is adjusted and which includes at least one vertical synchronization period, the luminance control signal for each of the at least one vertical synchronization period included in the dimming period, the driving control section is configured to provide a new scanning period in the dimming period, and the driving control section is configured to return the new scanning period to the pause period by ending the new scanning period at a timing at which the luminance control signal outputting section stops outputting the luminance control signal.

* * * * *